US007222630B2

(12) United States Patent
Silva

(10) Patent No.: US 7,222,630 B2
(45) Date of Patent: May 29, 2007

(54) LOCKING HAIR STICKS

(76) Inventor: David Alan Silva, 2314 Lafayette St., Santa Clara, CA (US) 95050

( * ) Notice: Subject to any disclaimer, the term of this patent is extended or adjusted under 35 U.S.C. 154(b) by 13 days.

(21) Appl. No.: 10/927,252

(22) Filed: Aug. 25, 2004

(65) Prior Publication Data

US 2005/0022837 A1 Feb. 3, 2005

(51) Int. Cl.
*A45D 8/04* (2006.01)
*B42F 1/00* (2006.01)

(52) U.S. Cl. ..... 132/273; 24/459

(58) Field of Classification Search ..... 132/273–284, 132/251, 254, 263, 261, 268, 246, 259; D28/39–41; 24/459, 115 G, 527, 528, 706.4; 446/85, 446/108, 111

See application file for complete search history.

(56) References Cited

U.S. PATENT DOCUMENTS

| | | | | | |
|---|---|---|---|---|---|
| 189,804 | A | * | 4/1877 | Smith | 132/251 |
| 235,680 | A | * | 12/1880 | Gray | 132/251 |
| 1,349,609 | A | * | 8/1920 | Ellert | 132/251 |
| 1,408,769 | A | * | 3/1922 | Nash | 132/246 |
| 2,696,215 | A | * | 12/1954 | Wettley | 132/282 |
| 2,737,188 | A | * | 3/1956 | Marshal | 132/282 |

* cited by examiner

*Primary Examiner*—Robyn Doan

(57) ABSTRACT

A hair-retaining device to be worn on the head comprising two attached hair sticks with a sliding fastening member removably connected to each of the hair sticks. The hair sticks retain a portion of a user's hair between the hair sticks.

6 Claims, 4 Drawing Sheets

LOCKING HAIR STICKS

BACKGROUND OF THE INVENTION

1. Field of the Invention

The present invention and method relates to a hair fastener. More particularly, to hair sticks comprising beads for connecting the hair sticks and for fastening hair there between.

2. Description of Prior Art

Many people like to fasten their hair into various styles. One popular way to fasten hair is to use hair sticks. Hair sticks are effective, however, they are difficult to use because the user has to tightly wrap the hair around them and try to secure them into their hair. The current invention allows the user to secure two sticks in the hair at the same time and to easily secure the two sticks to the user's hair by attaching a bead to couple the sticks together.

SUMMARY OF THE PRESENT INVENTION

An object of the present invention is to provide an instrument that is convenient, practical, and inexpensive for use in hair styling.

A further object is to provide an instrument that will keep a plurality of hair sticks attached together.

A further object is to provide an instrument that will keep hair secure between two hair sticks.

A further object is to provide an instrument that will keep hair secure between two beads that are attached to the two hair sticks.

A further object is to provide such an instrument that can be used unassisted by the individual styling their hair, eliminating the expense of a professional stylist.

A further object is to provide an instrument that can be reused over and over again.

A further object is to provide an instrument that will quickly hold the user's hair up in a neatly secured style.

According to one aspect of the present invention, there is provided two hair sticks attached toward one end to form a tong-like member. The hair sticks are connected toward a second end by a removably connected bead.

According to the arrangement described above, the removably connected bead is taken off the hair sticks. The hair sticks are placed into the user's hair and the removably connected bead is secured to the hair sticks by placing the sticks through the bead hole and sliding the bead toward the captured hair section to secure the hair between the hair sticks.

Accordingly a preferred embodiment, both the first stick and the second stick is attached to form a tong-like formation and the other end of each stick is attached by a removably connected bead, which holds hair between the sticks and between the connected end of the tong-like formation and the removably connected bead. The connected side that forms the tong-like formation can be connected at the ends or can be connected closer to the center of the sticks so that there is the illusion of two sticks going through the user's hair The removably connected bead slides onto the sticks with the sticks penetrating through them. The beads are preferably somewhat resilient or the sticks have a surface that restricts movement to keep the beads from sliding back the opposite direction from where they are slid (such as protrusions, detents, or ridges along the sticks). A nonresilient bead can also be used and is kept from sliding back the opposite direction from where it is slid also by protrusions, detents, or ridges along the sticks. A double holed bead could also be used with a stick placed through each corresponding hole. Further, additional beads can be added to secure additional sections of hair to the hair sticks and between each bead for example a third bead can be added to secure a third section of hair to the hair sticks.

In another embodiment both the side that holds the hair sticks in the tong-like position and the other side, are held together by a removably connected bead. A double holed bead could also be used to hold the hair sticks in the tong-like position.

In another embodiment the hair sticks are made of plastic and both the first bead that holds the hair sticks in the tong-like position (if this end isn't permanently attached) and the removably connected bead are plastic cord-lock like members. The type with a spring-loaded button used on drawstrings and the like. The cord-lock like member bead is a spring loaded bead comprising a separate button member with a hole in its side; the button member mates to the bead by placing the button member into an opening in the bead with a spring intermediate the button member and the bead; the spring makes the hole in the button member not line up with the hole in the bead when the button member isn't pressed by the user; the sticks pass through the bead by pressing the button until the hole in the button aligns with the hole in the bead. The hair sticks can have ridges along them to keep the bead from sliding back toward the opposite direction they were slid from. A double holed cord-lock like member could also be used with one stick through each hole. Further, additional cord-lock type members can be added to secure additional sections of hair between the hair sticks and between the additional cord-like type member and the one added previously.

Other objects, features and advantages of the present invention will become apparent from the following description of the preferred embodiments given with reference to the accompanying drawings.

BRIEF DESCRIPTION OF THE DRAWINGS

In the accompanying drawings

PREFERRED EMBODIMENTS

Figure 1:
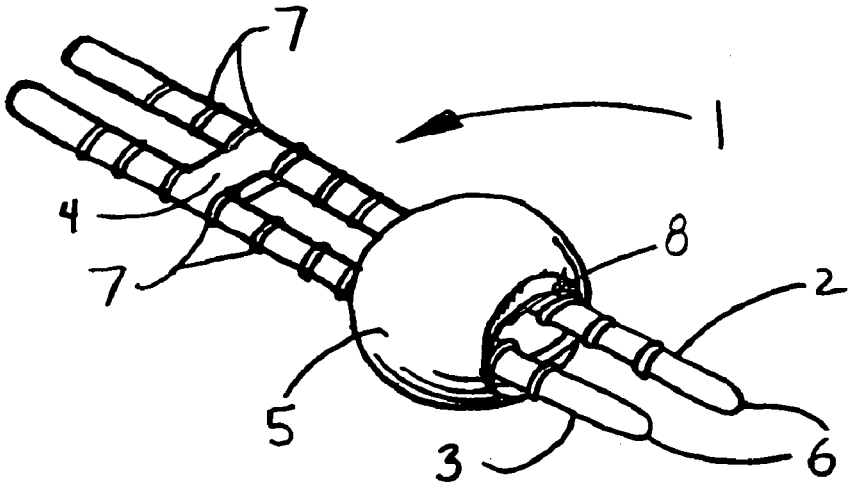
FIG. 1 is a plan view showing the locking hair sticks according to the present invention.
Figure 2:
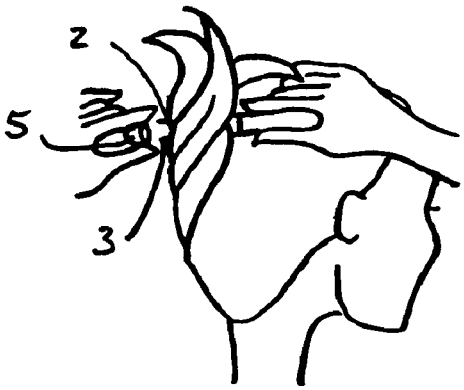
FIG. 2 is a schematic view showing the locking hair sticks according to the present invention.
Figure 3:
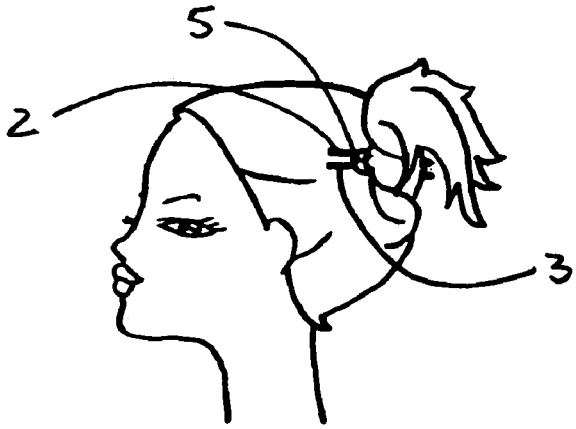
FIG. 3 is a schematic view showing another embodiment of the locking hair sticks according to the present invention.

Referring to FIG. 1 of the accompanying drawings, there is illustrated locking hair sticks, generally designated by reference numeral 1, embodying the present invention. The locking hair sticks 1 comprise a first hair stick 2 and a second hair stick 3. Both hair sticks 2 and 3 have ridges 7 along their length. One side of the invention is attached to form a tong-like member 4. A bead 5 has an inner textured surface 8 such as ridges, detents, dimples or a rubberized coating to keep it from sliding. Bead 5 is attached to the open ends 6 of the tong-like member 4 by placing the open ends 6 into and through the bead 5. In use FIGS. 2 and 3 the hair sticks 2 and 3 are placed into the hair and the bead 5 is placed on the hair sticks 2 and 3 and slid toward the captured hair section to secure the style. The ridges 7 keep the bead 5 from sliding back after it is slid forward.

Figure 4:
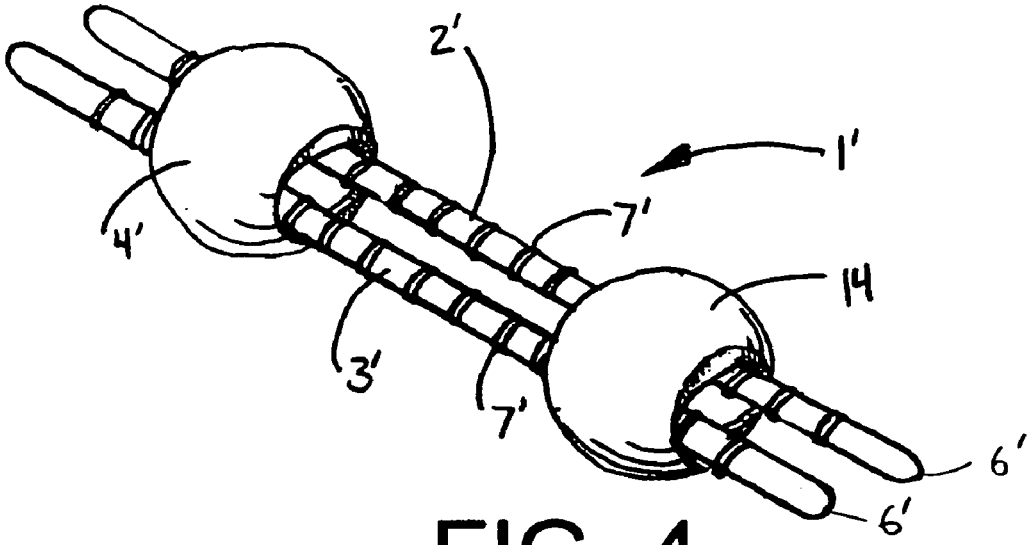
FIG. 4 is a plan view showing another embodiment of the locking hair sticks according to the present invention.
Figure 5:
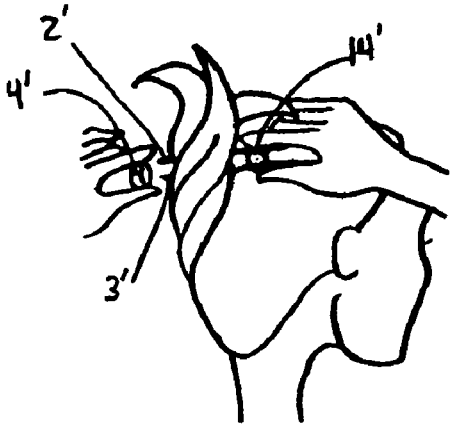
FIG. 5 is a schematic view showing another embodiment according to the present invention.
Figure 6:
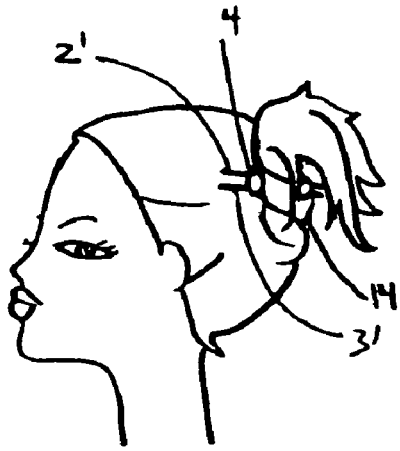
FIG. 6 is a schematic view showing another embodiment of the present invention.
Figure 7:
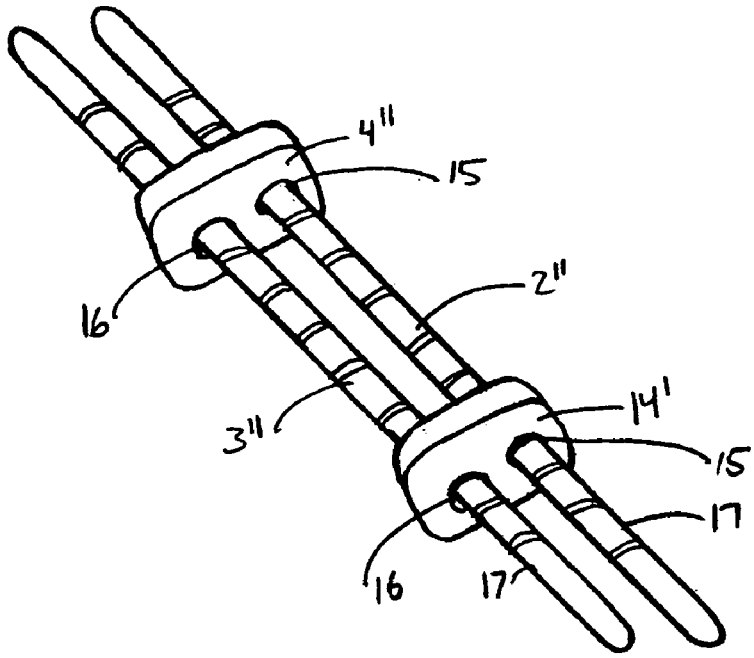
FIG. 7 is a plan view showing another embodiment of the present invention.

Referring to FIG. 4 of the accompanying drawings, there is illustrated locking hair sticks, generally designated by reference numeral 1', embodying the present invention. The locking hair sticks 1' comprise a first hair stick 2' and a second hair stick 3'. Both hair sticks 2' and 3' have ridges 7' in along their length. Each end of the hair sticks 2' and 3' have a bead 4' and 14 attached toward each end 6' of the hair sticks 2' and 3'. The use FIGS. 5 and 6 is the same as FIGS. 2 and 3 accept that both beads 4' and 14 can be slid toward each other with hair there between to secure. Referring to FIG. 7 the beads 4" and 14'could have a different hole 15 and 16 for each stick 2" and 3". The use (not shown) is the same as FIGS. 5 and 6 except that each stick is placed into a separate hole in the beads.

Figure 8:
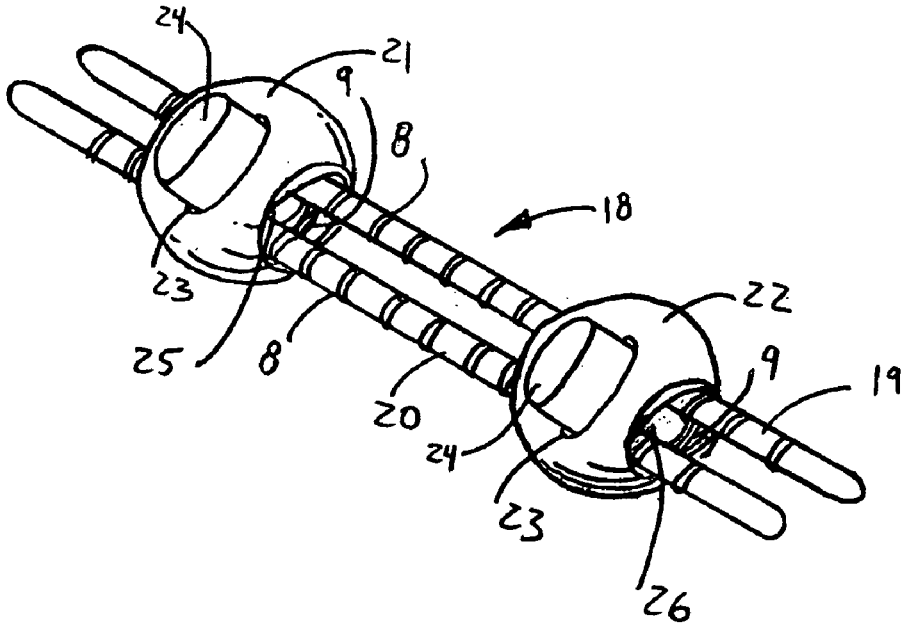
FIG. 8 is a plan view showing another embodiment of the present invention.
Figure 9:
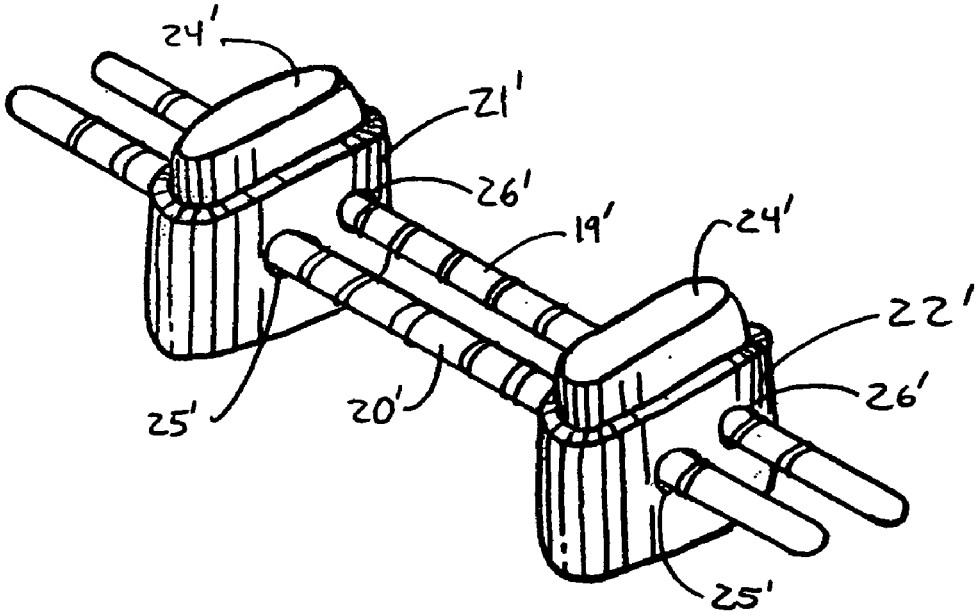
FIG. 9 is a plan view showing another embodiment of the present invention.

Referring to FIG. 8 of the accompanying drawings, there is illustrated locking hair sticks, generally designated by reference numeral 18, embodying the present invention. The locking hair sticks 18 comprise a first hair stick 19 and a second hair stick 20. Both hair sticks 19 and 20 have ridges 8 along their length. Each end of the hair sticks 19 and 20 have a locking bead 21 and 22 removably attached thereto. Each locking bead 21 and 22 consist of a hollowed member 23 and a button member 24 both the hollowed member 23 and the button member 24 has a hole 25 and 26. The button member 24 is snapped into the hollowed member 23 with a spring 9 there between. The use is the same (not shown) as the two bead version above FIGS. 5 and 6, however, the button members 24 are pressed to align the holes 25 and 26 in order to place the hair sticks 19 and 20 into the locking bead 21 and 22. The tension from the spring 9 keeps it in place after being slid toward the captured hair. Referring to FIG. 9 each locking bead 21' and 22' has a different hole 25' and 26' for each stick 19' and 20'. The use is the same (not shown) as above, however, the button members 24' are pressed to align both holes on each bead 21' and 22' in order to place the hair sticks 19' and 20' each into a separate hole.

Figure 10:
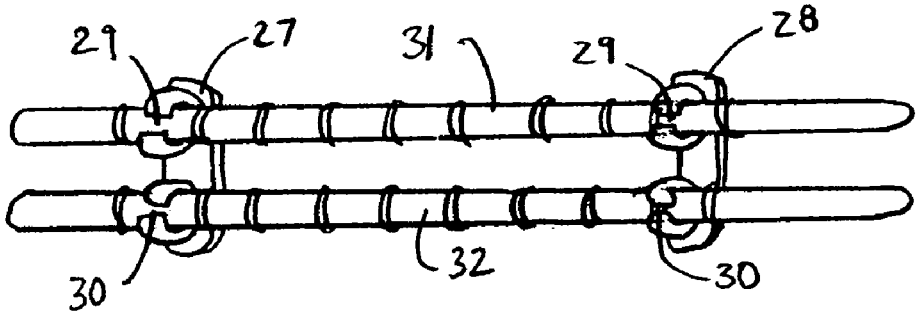
FIG. 10 is a plan view showing another embodiment of the present invention.

FIG. 10 shows double holed beads 27 and 28 with spaces 29 and 30, which enable the beads 27 and 28 to be snapped onto the sticks 31 and 32 before they are slid toward the captured section.

The present invention being thus described, the same may be varied in many ways. For instance, the hair sticks can be made of any material such as wood and additional beads can be attached to the sticks to capture additional hair sections. Further, any way to use the present invention obvious in the art should apply. Such variations are not to be regarded as a departure from the spirit and scope of the invention, and all such variations obvious to those skilled in the art are intended to be included within the scope of the claims,

I claim:

1. A hair retaining device comprising two rigid stick portions, each includes a first end and a second end; both stick portions are permanently attached to each other by a fastening member which is located away from both of said first and second ends thereby forming a first open end and second open end between the stick portions; a sliding bead having a though hole removably attached to both stick portions adjacent said second open end and being slidable toward a center of each stick portion, wherein the sliding bead has an inner textured surface, said inner textured surface being selected from the group consisting of ridges, detents, dimples or a rubberized coating to keep said sliding bead from sliding back in the opposite direction from which said sliding bead was slid along said stick portions until the user applies force to remove said sliding bead; and each of the stick portions having an outer textured surface, said outer textured surface being selected from the group consisting of ridges, detents or dimples along its length to keep the sliding bead from sliding, whereby a section of hair may be neatly secured between said stick portions by sliding said slidable bead toward said fastening member.

2. The device of claim 1, wherein a second sliding bead is attached to the stick portions capable of capturing a second hair section between the first sliding bead and the second sliding bead.

3. The device of claim 1, wherein a third sliding bead is attached to the stick portions capable of capturing a third hair section between the second sliding bead and the third sliding bead.

4. A method of retaining hair of a person comprising steps of:

providing a hair retaining device comprising two rigid stick portions, each includes a first end and a second end; both stick portions are permanently attached to each other by a fastening member which is located away from both of said first and second ends thereby forming a first open end and second open end between the stick portions; a sliding bead having a though hole removably attached to both stick portions adjacent said second open end and being slidable toward a center of each stick portion, wherein the sliding bead has an inner textured surface, said textured surface being selected from the group consisting of ridges, detents, dimples or a rubberized coating to keep said sliding bead from sliding back in the opposite direction from which said sliding bead was slid along said stick portions until the user applies force to remove said sliding bead; and each of the stick portions having an outer textured surface, said textured surface being selected from the group consisting of ridges, detents or dimples along its length to keep the sliding bead from sliding;

placing the stick portions into or around a section of hair with the sliding bead unattached, inserting both stick portions adjacent said second open end through said hole of the sliding bead, sliding the bead toward the section of hair, whereby the section of hair is neatly secured between said fastening member and said sliding bead.

5. The method of claim 4 wherein a second hair section is placed in between the stick portions and a second removably connected sliding bead is attached to the sticks portions.

6. The method of claim 4 wherein a third hair section is retained by adding a third removably connected sliding bead to the second end of the hair stick portions with the third hair section there between.

* * * * *